United States Patent [19]

Harms

[11] 4,269,381

[45] May 26, 1981

[54] PORTABLE COOK BOOK HOLDER

[76] Inventor: John F. Harms, 6418 Stony Brook Dr., Fort Wayne, Ind. 46815

[21] Appl. No.: 18,301

[22] Filed: Mar. 7, 1979

[51] Int. Cl.[3] ..... A47F 5/14; A47B 5/00

[52] U.S. Cl. ..... 248/222.2; 248/451; 248/249; 248/225.1; 211/181; 312/233

[58] Field of Search ..... 248/222.1, 205 R, 225.1, 248/225.2, 249, 250, 441 B, 441 C, 441 D, 453; 312/233; 211/24, 50, 181, 200

[56] References Cited

U.S. PATENT DOCUMENTS

| | | | |
|---|---|---|---|
| 338,300 | 3/1886 | Reade . | |
| 1,033,600 | 7/1912 | Beecher . | |
| 1,197,351 | 9/1916 | Dalglish | 248/441 |
| 1,728,613 | 9/1929 | Jones . | |
| 2,254,832 | 9/1941 | Weight | 312/188 |
| 3,074,745 | 1/1963 | Burckhalter | 248/441 B |
| 3,099,101 | 7/1963 | Burris | 248/441 C |
| 3,267,887 | 8/1966 | Boyd | 248/222.2 |
| 3,393,888 | 7/1968 | Henningsgard | 248/221 |
| 3,559,939 | 2/1971 | Luna | 248/210 |
| 3,995,744 | 12/1976 | Metcalf | 248/225.2 |
| 4,033,652 | 7/1977 | O'Brien | 312/245 |
| 4,117,936 | 10/1978 | Dawson | 248/441 D |

*Primary Examiner*—Casmir A. Nunberg
*Attorney, Agent, or Firm*—Albert L. Jeffers; John F. Hoffman

[57] ABSTRACT

A holder for cookbooks which will hold a cookbook above and off the counter surface in a position easily accessible for reference during cooking. The cookbook holder is formed of metal wire segments bent to shape and comprises a generally planar back frame having an upper portion and a lower portion and a pair of spaced apart sides adapted to support an open book. A ledge is connected to the lower portion of the back frame and extends generally forwardly therefrom and is adapted to support the lower edge of the book when it is resting on the back frame. Preferably, the ledge includes a lip which serves to engage the book in such a manner that it will be held open. Hook means connected to the upper end of the back frame are adapted for hooking around a vertical post or the like, such as the frame of a kitchen cabinet, a screw eye, etc. The hook means comprises a first metal rod segment connected to the back frame upper end intermediate the sides and extending generally forwardly and upwardly therefrom, a second metal rod segment connected to the first segment and extending perpendicularly thereto such that the first and second segments will follow the contour of the lower lip of the cabinet, and a third metal rod segment connected to the second segment and extending perpendicularly thereto, at least a portion of the third segment extending laterally with respect to the back frame so as to hook behind the vertical post.

15 Claims, 12 Drawing Figures

PORTABLE COOK BOOK HOLDER

BACKGROUND OF THE INVENTION

The present invention relates to book holders, and in particular to portable holders for cookbooks which will hold the cookbook in an easily accessible position for reference during cooking.

When preparing food, it is often necessary to refer repeatedly to the recipe, which is often contained in a cookbook. Since it would be inconvenient for the person preparing the food to have to open the book each time the recipe is referred to, it becomes desirable to provide means whereby the book can be laid open and easily accessible during cooking.

Probably the most common way for doing this is to simply lay the cookbook open on the kitchen counter, but this requires a certain amount of counter space, which may be at a premium if the counter space is limited or the dish which is being prepared requires elaborate preparation and, therefore, a greater expanse of counter space. Furthermore, when the book is laid on the counter, food may be dripped or splattered on it during the course of cooking. Although clear plastic cookbook holders have been provided for the purpose of protecting the open book from food, they occupy a considerable amount of valuable counter space in use and their size makes storage a problem.

Since it is often difficult to read a cookbook when it is supported on the level of the counter top. prior art devices have been devised for supporting the cookbook at a level which enables it to be more comfortably read by the person preparing the food. One such cookbook holder is disclosed in U.S. Pat. No. 2,254,832 and comprises a support which is slidably mounted for movement into and out of the cabinet and, when in a closed position, has the appearance of a drawer. Since this device is permanently installed, it requires specially designed kitchen cabinets. Furthermore, since the device is not portable, it cannot be moved from one location to another in the kitchen and its usefulness is, therefore, somewhat limited.

SUMMARY OF THE INVENTION

The present invention overcomes the disadvantages of prior art cookbook holders in that it is capable of holding a cookbook above and off the counter surface in a position convenient, comfortable and easily accessible for reference during the preparation of food, and, after use, can be removed and easily stored away until it is used again. The device is completely portable and is suspended over the counter surface from the cabinet above by hooking around one of the vertical posts of the cabinet or, alternatively, by hooking into a screw eye, around an extendable flush mounted bolt, U-clip, etc. secured in the floor of the cabinet. This renders the device extremely versatile in that it is capable of vertually universal use, regardless of the design of the kitchen cabinets, and can even be suspended from structures other than cabinets. When suspended, the book will be held at an angle and at a height which places the book conveniently before the person preparing the food.

The book holder includes a book supporting ledge having a lip which holds the book open at the selected page. Furthermore, the pages of the book can be easily turned by simply withdrawing the book partially from the holder, turning the page and then reinserting it into the holder.

Because the cookbook is suspended off the counter surface, it is not likely to be soiled by spilled or splattered food, and valuable counter space is left free for use.

Specifically, the present invention contemplates a portable book holder comprising: a back frame having an upper portion and a lower portion and a pair of spaced apart sides, the book frame being adapted to support an open book, ledge means connected to the lower portion of the back frame and extending forwardly from the back frame, the ledge means being adapted to support the lower edge of an open book, and hook means connected to the upper portion of the back frame intermediate the sides and adapted for hooking behind a vertical post or the like. The hook means comprises a first segment extending upwardly beyond the back frame, means connecting the first segment to the back frame, and a second segment connected to the first segment and extending transversely to the first segment in a generally lateral direction with respect to the back frame.

DETAILED DESCRIPTION

Figure 2:
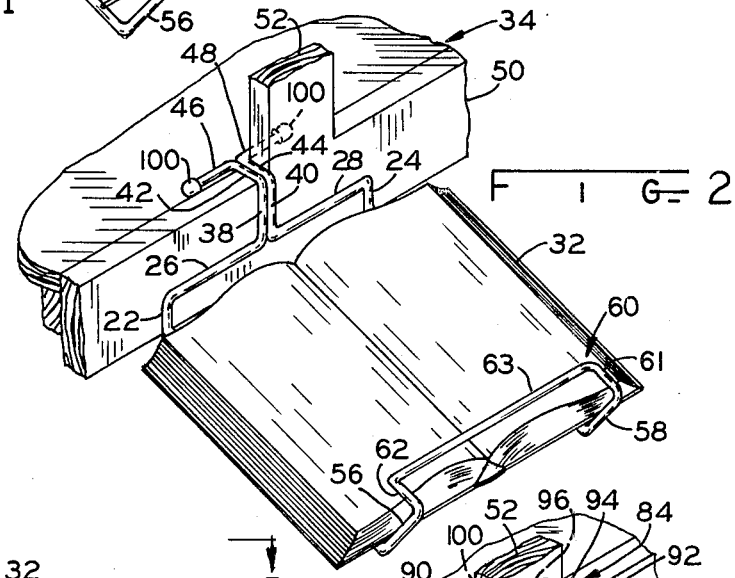
FIG. 2 is a perspective view showing a book inserted into the book holder of FIG. 1.
Figure 6:
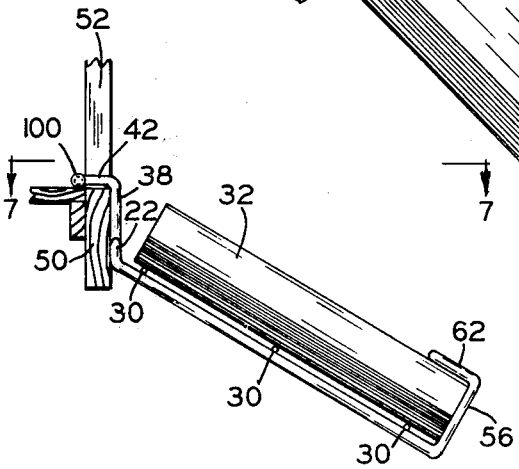
FIG. 6 is a side elevational view of the holder and book shown in FIG. 2.

Referring now to the drawings in detail, the cookbook holder 14 will be seen to comprise a metal rod 16 which is bent to shape. Holder 14 comprises a pair of side segments 18 and 20 integrally connected to a pair of upper segments 22 and 24 forming an obtuse angle with segments 18 and 20, respectively. Upper segments 22 and 24 are integrally connected to a pair of segments 26 and 28, which are perpendicular to and coplanar with segments 22 and 24. Three cross members 30, which are made of metal rods preferably of a somewhat smaller diameter than rod 16, are welded at their ends to side segments 18 and 20. Cross members 30 form a supporting plane for open book 32 (FIG. 2). Segments 18, 20, 22, 24, 26, 28 and 30 together comprise the back frame of holder 14. The angle between side segments 18 and 20 and respective upper segments 22 and 24 will depend on the desired angle of inclination for the book 32, but may be 120°, for example.

In order to suspend holder 14 from a kitchen cabinet 34, a suspension hook structure 36 is provided. Hook structure 36 comprises a pair of riser segments 38 and 40 integrally connected to segments 26 and 28 at the midpoint between sides 28 and 20, and preferably being perpendicular to segments 26 and 28, a pair of horizontal segments 42 and 44 integral with segments 38 and 40, respectively, and perpendicular thereto, and a pair of segments 46 and 48 integrally connected to segments 42 and 44, respectively, and perpendicular thereto. It will be noted that segments 38, 40 and 42, 44 are bent so that they conform to the front lower lip 50 of cabinet 34, and segments 44 and 48 are bent such that they hook around the center post 52 of cabinet 34 and suspend holder 14 outwardly from cabinet 34 over the counter top (not shown) which is immediately below cabinet 34 and holder 14. Thus, holder 14 is suspended by a cantilever action, which produces forces tending to cause holder 14 to rotate about the bends between segments 22 and 24 and 18 and 20, respectively, thereby pulling segment 48 against the rear surface 54 of post 52. With the additional weight produced by book 32, holder 14 will be securely anchored in place.

In order to prevent book 32 from sliding off holder 14, a ledge comprising segments 56 and 58, integrally connected to side segments 18 and 20, respectively, and being perpendicular thereto, is provided. Lip 60, which comprises integral segments 61, 62 and 63, provides a retaining means which will prevent the book 32 from closing when it is inserted in holder 14. It will be seen, however, that it is relatively easy to turn the pages of book 32, simply by partially removing book 32 from holder 14, turning the page, and then reinserting book 32 in holder 14.

Figure 4:
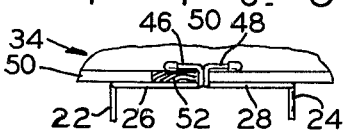
FIG. 4 is a view similar to FIG. 3 except that the book holder is suspended on the opposite side of the cabinet center post.
Figure 5:
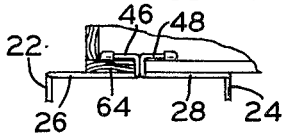
FIG. 5 is a view similar to FIG. 3 except that the book holder is suspended from the side post of the cabinet.

By virtue of oppositely extending segment 46, holder 14 can be suspended from the opposite side of center post 52, as illustrated in FIG. 4. Furthermore, this construction permits the holder 14 to be suspended from either of the side posts 64 of cabinet 34, as illustrated in FIG. 5. Thus, a considerable amount of versatility is realized with the book holder 14 of the present invention, because it can be used with a wide variety of cabinet designs, and can be moved about from place to place within the kitchen simply by opening the cabinet door and hooking it in place.

Figure 9:
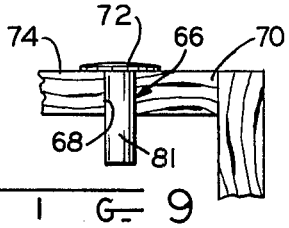
FIG. 9 is an enlarged sectional view showing the pin of FIG. 8 in its retracted position.
Figure 8:
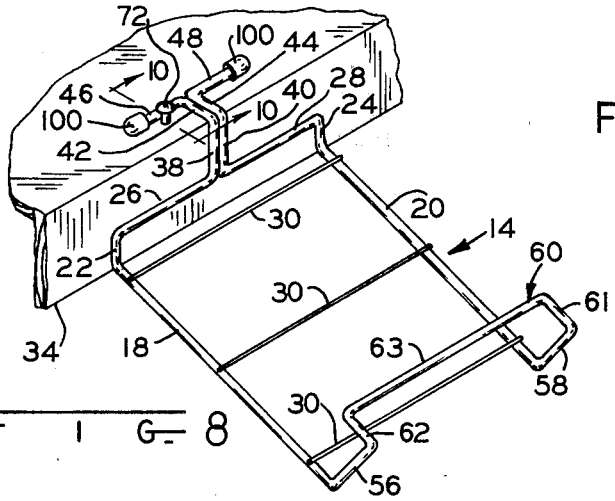
FIG. 8 is a perspective view of the book holder suspended from an extendable flush-mounted pin.
Figure 10:
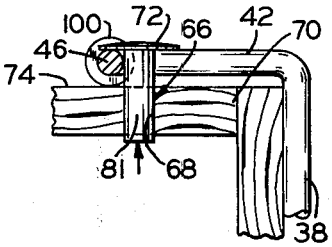
FIG. 10 is a sectional view taken along line 10—10 of FIG. 8 and viewed in the direction of the arrows.

An alternative technique for suspending holder 14 is shown in FIGS. 8, 9 and 10, and is useful when it is desired to suspend the holder 14 from a position other than adjacent the cabinet center post 52 or one of the side posts 64. A pin 66 is slidably received in a hole 68 in the floor 70 of cabinet 34, and comprises a wide flat head 72 which is nearly flush with the surface 74 of floor 70 when pin 66 is fully retracted. Holder 14 is hung by extending pin 66 such that there is sufficient clearance between head 72 and surface 74 to permit one of the segments 46 or 48 to be hooked around pin 66 beneath head 72. Segment 46 will be urged against pin 66 by the cantilever action discussed above, and holder 14 will be held in place.

Figure 12:
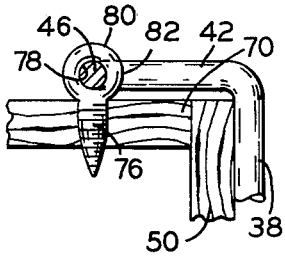
FIG. 12 is a sectional view taken along line 12—12 of FIG. 11 and viewed in the direction of the arrows.
Figure 11:
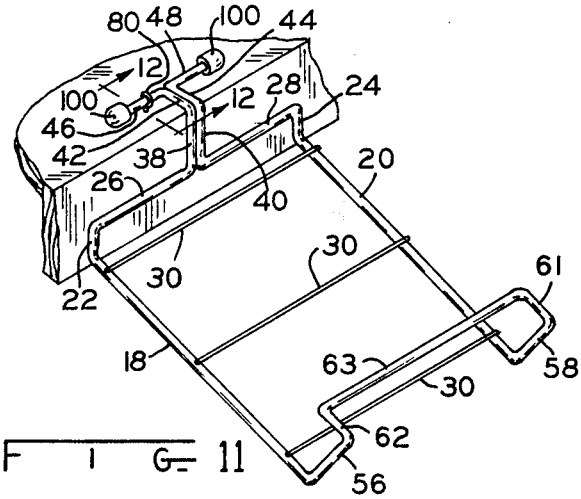
FIG. 11 is a perspective view of the book holder suspended from a screw eye secured to the floor of the cabinet.

A further alternative mounting method is shown in FIGS. 11 and 12, and comprises a screw eye 76 which is screwed in the floor 70 of cabinet 34, and one of the segments 46 or 48 is inserted into the opening 78 formed in the eye 80. In each of the mounting arrangements shown in FIGS. 8 and 11, segments 42 or 44 and segments 46 or 48 hook around the vertical "post", which, in the case of pin 66 is its shank 81, and in the case of screw eye 76, is the forward half 82 of eye 80.

Figure 1:
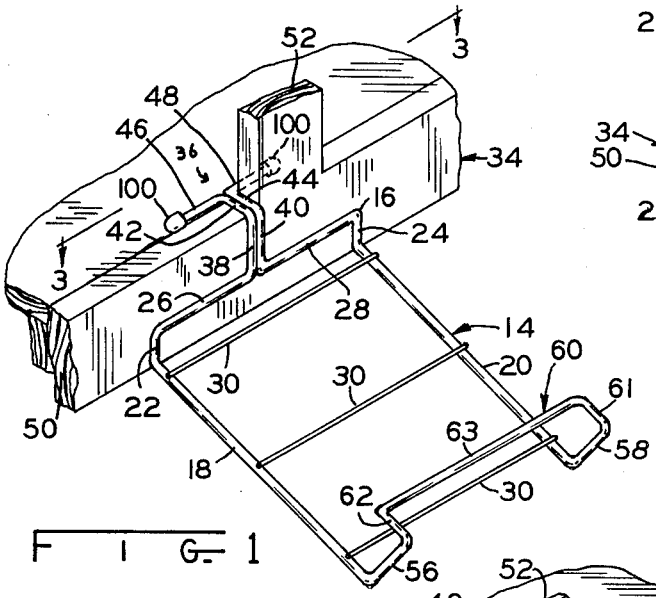
FIG. 1 is a perspective view of the book holder according to the present invention shown suspended from a kitchen cabinet.
Figure 3:
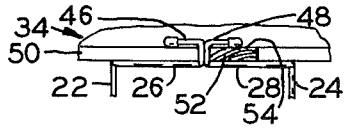
FIG. 3 is a sectional view, on a reduced scale taken along line 3—3 of FIG. 1 and viewed in the direction of the arrows.
Figure 13:
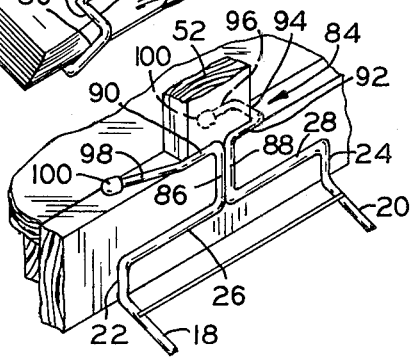
Figure 7:
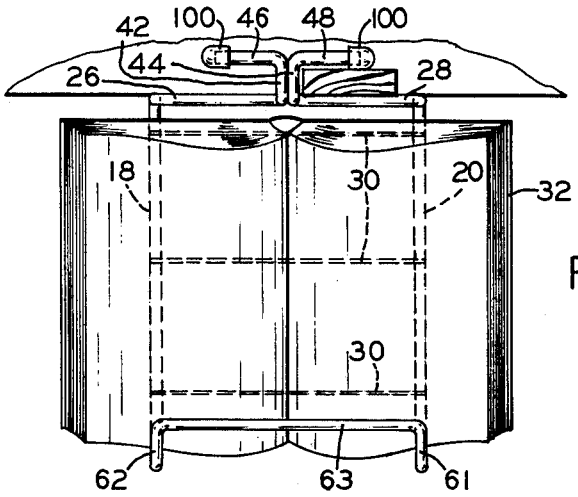
FIG. 7 is a sectional view taken along line 7—7 of FIG. 6 and viewed in the direction of the arrows.

An alternative embodiment of the invention is illustrated in FIG. 13. In place of oppositely extending segments 46 and 48 adapted to hook around the cabinet posts 52 and 64, a single hook 84 is provided. As is the case in the embodiment of FIG. 1, riser segments 86 and 88 are perpendicular to segments 26 and 28 but, rather than being bent upwardly as are segments 42 and 44, they are bent laterally to form segments 90 and 92. Integral with segment 92 are segment 94, which extends along center post 52, and segment 96, which is integral with and perpendicular to segment 94 and extends behind and hooks around center post 52. Segments 92, 94 and 96 are coplanar. Segment 98, which is integral with segment 90, forms an obtuse angle with segment 90. This causes segment 98 to extend partially over the lower lip 50 of cabinet 34, which serves to stabilize the book holder 14 against tilting movement about its long axis.

Although the major part of holder 14 has been shown as a single integral metal rod bent to shape, it could alternatively be formed of a plurality of segments which are welded together. In order to prevent marring of the cabinet surface, it may be desirable to coat holder 14 with a suitable plastic.

To install holder 14, one of the cabinet doors (not shown) is opened and the upper portion is hooked around the center post 52, or one of the side posts 64, or around one of the auxiliary anchoring devices such as pin 66 or screw eye 76. The frictional forces resulting from the pressure of segments 44 or 48 against the rear surface 54 of post 52, and of segments 42, 44, 38, 40, 26, 28, 22 and 24 against the lip 50 of cabinet 34 will retain book holder 14 securely in place. Holder 14 may be moved to a different location simply by raising the lower portion and sliding it either to the left or right depending on the manner in which it was emplaced.

If desired, the ends of segments 46, 48, 96 and 98 may be provided with flexible plastic caps 100.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A portable book holder comprising:

a back frame having an upper portion and a lower portion and a pair of spaced apart sides, said back frame being adapted to support an open book, ledge means connected to the lower portion of said back frame and extending forwardly from said back frame, said ledge means being adapted to support the lower edge of an open book, and hook means connected to the upper portion of said back frame intermediate said sides and adapted for removably hooking behind a vertical post or the like, said hook means comprising a first segment extending upwardly beyond said back frame, means connecting said first segment to said back frame, and a second segment connected to said first segment and extending transversely to said first segment in a generally sidewise lateral direction with respect to said back frame, said second segment terminating in a free end whereby said second segment can hook around a vertical post or the like.

2. The book holder of claim 1 wherein said back frame defines a support plane for the book to be supported thereon, said ledge means is generally perpendicular to said support plane, and said second segment is generally parallel to said support plane.

3. The book holder of claim 1 wherein said means for connecting said first segment to said back frame comprises a riser segment connected to said back frame and to said first support, said riser segment being perpendicular to said first segment.

4. The book holder of claim 3 wherein said second segment is perpendicular to said first segment and coplanar therewith.

5. The book holder of claim 1 wherein:

said back frame is generally planar and includes a lower end, said ledge means comprises a first portion connected to said back frame lower end and extending generally perpendicular to the plane of said back frame, said ledge means further comprises a second portion connected to said first portion and extending generally parallel to the plane of said back frame, said second portion being adapted to hold open the book to be supported.

6. The book holder of claim 1 wherein said means for connecting said first segment to said back frame comprises a third segment connected to said back frame and extending generally forwardly therefrom, and a fourth segment connected to said third segment and to said first segment, said first, second and fourth segments being generally coplanar, and said third segment being generally perpendicular to the plane of said first, second and fourth segments.

7. The book holder of claim 1 wherein said holder is made of metal rod bent to shape.

8. A portable book holder comprising:

a back frame constructed of metal rod segments, said back frame having an upper end, a lower end, and a pair of spaced apart sides, said segments defining a support plane on which an open book is to be supported, a ledge comprising at least two metal rod segments connected to the lower end of said back frame extending forwardly from said back frame and being perpendicular thereto, and hook means connected to the upper end of said back frame adapted for hooking around a vertical post or the like, said hook means comprising: a first metal rod segment connected to said back frame upper end intermediate said sides and extending forwardly and upwardly therefrom, a second metal rod segment connected to said first segment and extending perpendicularly thereto in a direction away from said back frame, and a third metal rod segment connected to said second segment and extending perpendicularly thereto, at least a portion of said third segment extending laterally with respect to said back frame, said third segment terminating in a free end whereby said third segment can hook around a vertical post or the like.

9. The book holder of claim 8 including a fourth metal rod segment connected to said third segment and extending transversely thereto, said second, third and fourth segments being coplanar.

10. In combination with a stationary, generally vertical post means having a front, a back and at least one side, a portable book holder hooked around said post means and comprising:

a back frame having an upper portion and a lower portion and a pair of spaced apart sides, said back frame being adapted to support an open book, ledge means connected to the lower portion of said back frame and extending forwardly from said back frame, said ledge means being adapted to support the lower edge of an open book, and hook means connected to the upper portion of said back frame and hooking around said post means to suspend said holder, said hook means comprising: a first segment and means for connecting said first segment to said back frame at a point intermediate said sides, said first segment extending upwardly beyond said back frame, and a second segment connected to said first segment and extending perpendicular to said first segment in a generally lateral direction with respect to said back frame, said first segment extending along one side of said post means and said second segment being disposed behind said post means and in pressing engagement with said post means back, whereby said holder hooks around and hangs from said post means.

11. The combination of claim 10 wherein said post means comprises a pin vertically slidably received in a surface opening.

12. The combination of claim 10 wherein said post means comprises an eye fastener secured to a planar surface and said second segment is received in said eye.

13. A portable book holder comprising:

a back frame constructed of metal rod segments, said back frame having an upper end, a lower end, and a pair of spaced apart sides, said segments defining a support plane on which an open book is to be supported, a ledge comprising at least two metal rod segments connected to the lower end of said back frame extending forwardly from said back frame and being perpendicular thereto, hook means connected to the upper end of said back frame adapted for hooking around a vertical post or the like, said hook means comprising: a first metal rod segment connected to said back frame upper end intermediate said sides and extending forwardly and upwardly therefrom, a second metal rod segment connected to said first segment and extending perpendicularly thereto, and a third metal rod segment connected to said second segment and extending perpendicularly thereto, a third metal rod segment connected to said second segment and extending perpendicularly thereto, at least a portion of said third segment extending laterally with respect to said back frame, a fourth metal rod segment connected to said third segment and extending transversely thereto, said second, third and fourth segments being coplanar, and a fifth metal rod segment connected to said back frame and having a portion thereof extending laterally and upwardly from said back frame.

14. A portable book holder comprising:

a back frame constructed of metal rod segments, said back frame having an upper end, a lower end, and a pair of spaced apart sides, said segments defining a support plane on which an open book is to be supported, a ledge comprising at least two metal rod segments connected to the lower end of said back frame extending forwardly from said back frame and being perpendicular thereto, and hook means connected to the upper end of said back frame adapted for hooking around a vertical post or the like, said hook means comprising: a first metal rod segment connected to said back frame upper end intermediate said sides and extending forwardly and upwardly therefrom, a second metal rod segment connected to said first segment and extending perpendicularly thereto, a third metal rod segment connected to said second segment and extending perpendicularly thereto, at least a portion of said third segment extending laterally with respect to said back frame, and a fourth metal rod segment connected to said back frame and having an end portion colinear with and extending in a direction away from said third segment.

15. In combination with a cabinet having a frame including a generally vertical post means with a front, a back and at least one side, a portable book holder comprising:

a back frame having an upper portion and a lower portion and a pair of spaced apart sides, said back frame being adapted to support an open book, ledge means connected to the lower portion of said back frame and extending forwardly from said back frame, said ledge means being adapted to support the lower edge of an open book, and hook means connected to the upper portion of said back frame and hooking around said post means to suspend said holder, said hook means comprising a first segment and means for connecting said first segment to said back frame at a point intermediate said sides, said first segment extending upwardly beyond said back frame, and a second segment connected to said first segment and extending perpendicular to said first segment in a generally lateral direction with respect to said back frame, said first segment extending along one side of said post means and said second segment being disposed behind said post means and in pressing engagement with said post means back.

* * * * *